US005168908A

United States Patent [19]

Boyum

[11] Patent Number: 5,168,908

[45] Date of Patent: Dec. 8, 1992

[54] NON-SPILL FUNNEL

[76] Inventor: Glenn Boyum, P.O. Box 527, International Falls, Minn. 56649

[21] Appl. No.: 811,108

[22] Filed: Dec. 20, 1991

[51] Int. Cl.[5] ..... B67C 11/00; B65B 39/00

[52] U.S. Cl. ..... 141/340; 141/331

[58] Field of Search ..... 141/331, 337, 338, 98, 141/340-342, 344, 345, 311 A, 363-366; 248/94

[56] References Cited

U.S. PATENT DOCUMENTS

| | | | |
|---|---|---|---|
| 213,244 | 3/1879 | Pettibone | 141/340 |
| 293,986 | 2/1884 | Stover | 141/340 |
| 324,547 | 8/1885 | Freygang | 141/340 X |
| 475,874 | 5/1892 | Leggett | 141/340 |
| 641,267 | 1/1900 | Cahill | 141/340 X |
| 657,080 | 9/1900 | Belden | 141/331 |
| 944,914 | 12/1909 | Rugg | 141/340 |
| 959,715 | 5/1910 | Carson | 141/340 |
| 1,293,297 | 2/1919 | Anderson | 248/94 X |
| 1,302,086 | 4/1919 | Pitlick | 141/340 |
| 1,456,407 | 5/1923 | Scherer | 141/366 |
| 1,484,357 | 2/1924 | Mullen | 141/340 |
| 1,536,890 | 5/1925 | Lagemann | 248/94 |
| 1,633,343 | 6/1927 | Miller | 141/340 |
| 1,733,261 | 10/1929 | Higby et al. | 141/337 |
| 1,820,406 | 8/1931 | Thompson | 141/340 |
| 2,098,374 | 11/1937 | Bullock | 248/94 |
| 2,149,722 | 3/1939 | Blanchard | 248/94 |
| 2,255,573 | 9/1941 | Timian et al. | 248/94 |
| 2,349,691 | 5/1944 | Amstutz | 248/94 |
| 2,620,957 | 12/1952 | Taylor | 248/94 X |
| 2,694,515 | 11/1954 | Green | 141/340 X |
| 2,703,670 | 3/1955 | Voight | 141/340 |
| 2,811,181 | 10/1957 | Correll | 141/340 |
| 2,883,057 | 4/1959 | Richards | 248/94 |
| 3,086.223 | 4/1963 | Gass | 248/94 X |
| 4,217,940 | 8/1980 | Wheeler | 141/98 |
| 4,494,581 | 1/1985 | Gordon | 141/98 X |
| 4,951,721 | 8/1990 | Moore et al. | 141/331 |
| 4,997,013 | 3/1991 | Peckels | 141/340 X |
| 5,074,343 | 12/1991 | Tyree, Jr. | 141/340 X |

FOREIGN PATENT DOCUMENTS

| | | | |
|---|---|---|---|
| 0110522 | 4/1928 | Austria | 141/340 |
| 0041375 | 9/1916 | Sweden | 141/340 |
| 0093186 | 11/1938 | Sweden | 141/331 |
| 0099220 | 6/1940 | Sweden | 141/344 |
| 0153444 | 2/1956 | Sweden | 141/340 |

*Primary Examiner*—Henry J. Recla
*Assistant Examiner*—Casey Jacyna
*Attorney, Agent, or Firm*—Dowell & Dowell

[57] ABSTRACT

A non-spill funnel for introducing liquids and flowable materials into tanks or containers which includes a bowl which is integrally formed with a pour spout or nozzle and wherein the nozzle includes an outwardly spaced arcuate flange which extends in spaced relationship thereto for purposes of engaging the sidewall of the fill spout opening into the tank or container so as to retain the nozzle against the sidewall thereof so that a visual inspection may be made as to the level of liquid or other flowable material relative to the opening.

8 Claims, 1 Drawing Sheet

NON-SPILL FUNNEL

BACKGROUND OF THE INVENTION

1. Field of the Invention

This invention is generally directed to funnels for conveying liquids and other flowable materials from a source of supply into a tank or other container wherein the container has an opening defined by a fill spout. More specifically, the invention is directed to a funnel having an arcuate mounting flange integrally formed with the funnel nozzle and which extends outwardly from the nozzle in spaced relationship with respect thereto for clampingly engaging the fill spout of the container therebetween. In this manner, the nozzle of the funnel is retained against the inner sidewall of the container opening thereby allowing an individual to visually determine the accurate level of fluid or other material being introduced into the container. In a preferred embodiment of the present invention, the mounting flange includes a plurality of ribs for engaging the lip or screw threads associated with the container fill spout.

2. History of the Related Art

At one time or another almost every individual has had an experience in which they have had to pour fluids, such as gasoline, from a gasoline can into a tank of a lawn mower or other implement or vehicle. Normally, a conventional funnel is utilized to facilitate the transfer of the fluid from the can to the tank in an effort to reduce spillage. Most conventional funnels are provided with a bowl-shaped receiving portion which tapers towards a nozzle which is inserted within the inlet opening of the receiving tank. Unfortunately, as the tank is being filled with the liquid or other flowable material, there are no means to accurately gauge the level of the fluid within the receiving tank and frequently too much liquid is introduced into the tank resulting in an overflow or spill. In some instances, overflows are only an inconvenience, however, in others, such as where hydrocarbon fuels are being added to powered implements or automotive vehicles, the spill results in environmental contamination and is also a source of tremendous waste of natural resources.

The transfer of fluids or flowable materials utilizing funnels is not restricted to any areas, such as automotive equipment. Often, hazardous materials such as chemicals, caustic fluids, hot liquids and the like, are transferred utilizing funnels and similar devices. Spills of such materials could be hazardous or dangerous to individuals. It is therefore important to provide funnels which will insure that spillage is prevented, thereby not only reducing waste of the material being transferred but also preventing possible damage to the environment and/or injury to individuals.

Over the years many funnels have been designed to prevent overflows or spills of the material being poured from one container to another. In U.S. Pat. No. 324,547 to Freygang, a funnel for filling oil lamps is disclosed which includes a funnel body having a nozzle which is seated within the neck of the lamp base and which is retained in position by the use of a spring which is fixed to the body of the funnel. The funnel is designed to be mounted to the neck of the lamp base so that the nozzle is offset to one side of the inlet opening so that the wick of the lamp is not interfered with during filling. An indication that the lamp is filled is provided by a float device having an elongated stem which is inserted up through the central portion of the funnel. When the float rises, the stem will rise, and when the float engages the bottom of the nozzle, further dispensing is prevented thereby giving an indication that the level within the lamp is at a predetermined level. There are other float type funnels which have been designed for reflecting the level of fluid within a container. Unfortunately, such devices are complicated and expensive and are subject to failure after use. Such float devices are not reliable when the stems which mount them to the funnels become rusted, worn, bent, or otherwise damaged through continuous use. Further, even though float devices may give an indication that a certain level has been reached, if a sufficient quantity of fluid has already been introduced into the body or bowl of the funnel before the proper level is detected, such fluid will either overflow the container or must be poured from the funnel back into the supply receptacle. Therefore, float type devices do not give a satisfactory indication of the rate at which the level within a container being filled is rising so that an individual filling the container may accurately determine the amount of fluid or flowable material which may be subsequently added to the container at any point in time.

A further limitation of funnels having moveable indicators, such as disclosed in the patent to Freygang, is that they are not adapted to be utilized except in an upright vertical orientation. If a funnel is mounted at an angle, the float will not operate properly.

In U.S. Pat. No. 657,080 to Belden, a funnel is disclosed having an air tube which is inserted into the throat of the container being filled. The air tube is configured so as to provide an audible signal as the pressure within the container changes as material is being introduced therein. Once the material reaches a certain level within the container, the airflow tube is blocked thereby stopping the production of sound and giving an indication that a certain level within the container has been reached. Unfortunately, these types of funnels require complicated structures which are not conducive for everyday use and also are structures which may become easily blocked by dirt and other debris. Further, as with the sliding type indicators discussed above, such sounding type funnels do not indicate the rate at which the fluid or other flowable material is filling the container and therefore, at the time in which the sound indicates that the container is filled, it is possible that additional fluid has already been introduced into the funnel and will pass into the container causing a possible overflow.

Another type of funnel-like device which is used to measure a specific quantity of flowable material to be introduced into a container is disclosed in U.S. Pat. No. 1,633,343 to Miller. The Miller device includes an outwardly extending clamp arm mounted to the side of the funnel nozzle so that the nozzle is engaged against the lip into the opening into a container in which the nozzle is inserted. The clamp is connected to a valve extending through the nozzle so that as the device is fitted over the lip of the container inlet spout, the outward movement of the arm opens the valve allowing a premeasured amount of material to be discharged from the device into the container. The spring arm, however, does not provide a secure means for retaining the nozzle of the device in fixed relationship with respect to the inlet spout of the container.

The prior art also discloses numerous holders for supporting funnels within the openings into containers to be filled. Although some holders provide structure for supporting the funnels in offset relationship with respect to the inlet openings of the containers, the holders are separate devices which may not be readily available at the time a funnel is to be used. In addition, such holders normally include a lip engaging portion and a funnel engaging ring. As the lip engaging portion overhangs the lip of an inlet spout into a container, the funnel is supported within the ring of the holder. In many instances, the holders are pivotally moveable with respect to the lip of the container and are only adequately used when the container is vertically oriented. Therefore, such devices are not appropriate for use when the inlet opening into a container is at an angle, as is the case with many automobile gasoline tank fill spouts. Some examples of holders for funnels are disclosed in U.S. Pat. Nos. 1,536,890 to Lagemann, 2,149,722 to Blanchard, and 2,349,691 to Amstutz.

Other examples of prior art funnel mounting devices are disclosed in U.S. Pat. Nos. 475,874 to Leggett, 944,914 to Rugg, 2,703,670 to Voight, and 4,951,721 to Moore et al.

SUMMARY OF THE INVENTION

This invention is directed to a funnel for allowing containers and tanks to be filled while permitting visual inspections to be made through the fill spout opening into the container or tank to determine the level of fluid therein. The funnel includes a conical body or bowl which tapers to an elongated neck or nozzle. A generally arcuate support flange is integrally formed with the nozzle and extends outwardly adjacent the lowermost end thereof so as to define an arcuate space or groove between the nozzle and the flange in which a segment of the wall of an intake or fill spout of the container may be securely seated to thereby support the funnel in fixed relationship with respect thereto. In the preferred embodiment, the flange is provided with a plurality of inwardly oriented ribs which are vertically spaced with respect to one another and which are of a size to cooperatively engage the lip of the fill spout or screw threads associated with such spouts.

With the present device, the funnel nozzle is designed to be relatively narrow with respect to the inlet opening into the container to be filled so that when the funnel is clamped to the edge or rim of the opening, the nozzle will not obstruct the opening and thus will permit visual inspection into the container.

It is a primary object of the present invention to provide a funnel which is easy to use and which is directly mounted to the rim of an opening into conventional tanks and containers so that a visual inspection may be made of the level of the contents thereof so that overflows or spills from the containers or tanks are prevented.

It is another object of the present invention to provide a funnel having an integrally formed mounting or clamping flange member by way of which the funnel is secured in engagement with the lip of the fill spout of a conventional container and the funnel supported regardless of the angle of orientation between the funnel and the container during use.

DESCRIPTION OF THE PREFERRED EMBODIMENT

Figure 1:
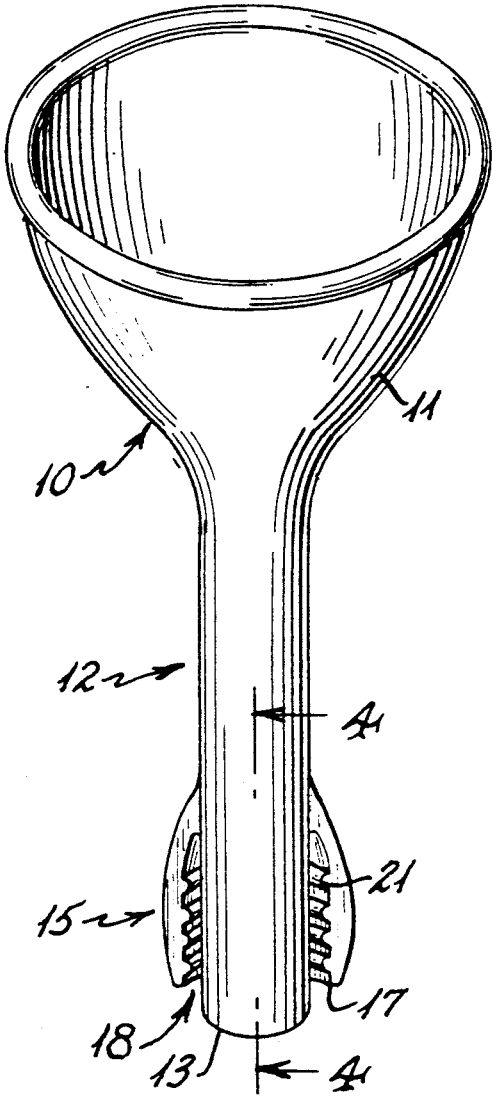
FIG. 1 is a front perspective view of the funnel of the present invention.
Figure 2:
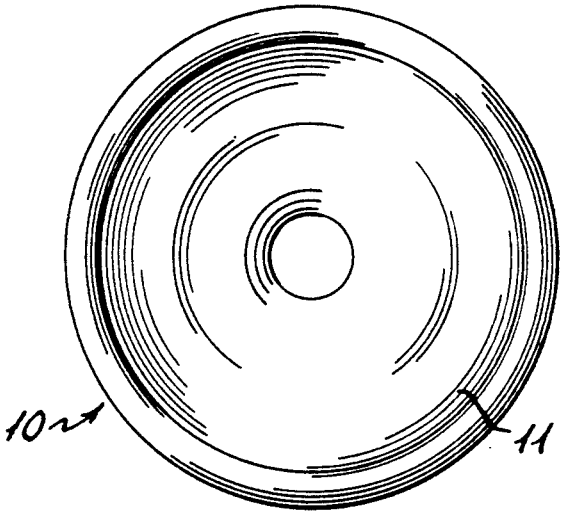
FIG. 2 is a top plan view of the funnel of FIG. 1.
Figure 3:
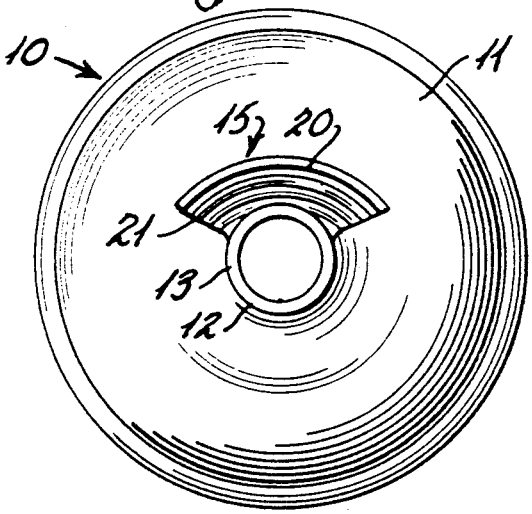
FIG. 3 is a bottom plan view of the funnel of FIG. 1.
Figure 4:
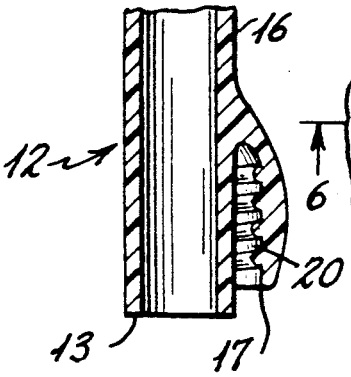
FIG. 4 is a partial cross-sectional view taken along lines 4—4 of FIG. 1.

With continued reference to the drawing figures, the funnel 10 of the present invention includes a conically shaped open bowl portion 11, which tapers to an elongated tubular nozzle 12, having a discharge end 13. The bowl 11 and nozzle 12 are of conventional configuration and are preferably integrally formed of molded plastic or nonsparking metallic material such as aluminum. The nozzle 12 is shown as being of generally cylindrical configuration, however, in some instances, the nozzle may be slightly tapered from the bowl 11 to the discharge end 13 thereof.

The funnel of the present invention is specifically designed to be self-supporting relative to a container or tank C being filled and, in this respect, includes a generally arcuately shaped mounting flange 15 which extends outwardly from the sidewall 16 defining the nozzle 12 and adjacent the lower end portion 13 thereof. The mounting flange 15 is shown as tapering outwardly from the sidewall 16 of the nozzle 12 along its length with the lowermost end portion thereof 17 terminating adjacent to, but spaced from, the lower end portion 13 of the nozzle. An arcuately tapered groove 18 is thereby defined between the mounting flange 15 and the nozzle 12, in which a segment of the lip L or rim of a container fill spout S is selectively received. In the preferred embodiment, the flange is integrally formed with the nozzle.

Figure 6:
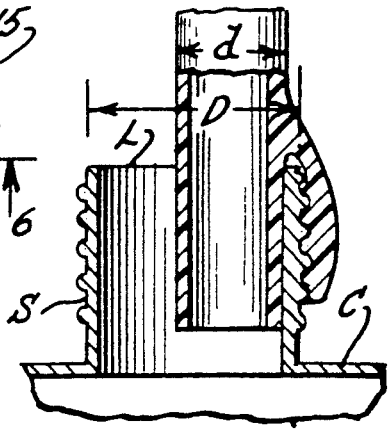
FIG. 6 is a cross-sectional view taken along lines 6—6 of FIG. 5.

With specific reference to FIG. 6 of the drawings, as the nozzle and opposing clamp are inserted over the lip L of the container fill spout S, the lip will become progressively wedged therebetween thereby insuring a tight fit and thus a secure mounting engagement between the funnel and the container C. It should also be noted that the mounting flange 15 has an elongated arcuate configuration and extends approximately 120° with respect to the sidewall 16 of the nozzle 12. It is generally preferred that the flange extend at least 90° with respect to the sidewall and may extend more than 120° with respect thereto. In this manner, an elongated mounting slot is developed between the flange and the nozzle thus insuring that the funnel will be securely seated relative to a container when placed over the lip L of the container fill spout.

Figure 5:
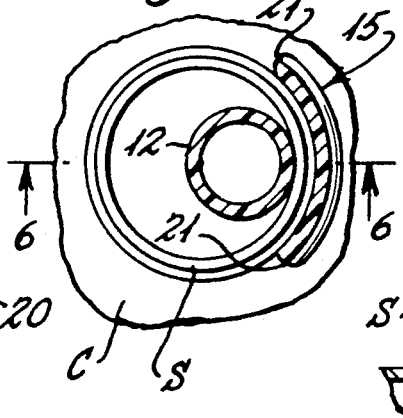
FIG. 5 is a top plan view of a receptacle to which the funnel of FIG. 1 is attached showing the funnel in cross section.

In order to permit the flange 15 to be used on fill spouts having differing diameter lips or rims, and as shown in FIG. 5, the outer side edges 21 of the flange are slightly flared outwardly with respect to the sidewall 16 of the nozzle 12. In those instances where the funnel is formed of a plastic material, it is possible that the mounting flange 15 is formed concentrically with respect to the nozzle, however the flange would yield resiliently when being placed over the lip or rim of the container fill spout.

To further secure the funnel with respect to a container fill spout, in the preferred embodiment and as shown in the drawing figures, the mounting flange 15 is provided with a plurality of spaced arcuate ribs 20 which extend inwardly therefrom toward the nozzle 12.

The ribs serve to anchor the funnel against either the upper lip, which is conventionally associated with many tanks or containers, or engage the screw threads which are also associated with many conventional tanks or containers.

In the use of the funnel of the present invention, when it is desired to fill a container or tank C, the lower end of the funnel is inserted over the lip or rim L of the fill spout S until the clamp or flange 15 is fully seated with respect thereto thereby urging the sidewall 16 of the nozzle 12 of the funnel against the lip, as is shown in FIG. 6. As the diameter "d" of the nozzle 12 is substantially less than the diameter "D" of the opening in the fill spout, a substantial area is open to permit visual inspection of the level of fluid or other material within the container. In this manner, accidental spillage by supplying too much fluid or other flowable material into the container or tank is effectively avoided.

I claim:

1. A funnel which is self-supported in relationship to the fill spout of a tank or container wherein the fill spout has an opening of a first diameter, the funnel comprising, a bowl portion and a nozzle extending from said bowl portion to a lower open end, said nozzle having a second diameter which is substantially less than said first diameter, an arcuate mounting flange connected to and extending outwardly from and generally parallel to only a portion of the periphery of said nozzle adjacent said lower open end thereof, an open arcuate groove defined between said flange and said nozzle in which a segment of the fill spout is selectively received so that said nozzle and a substantial portion of said flange abuts a portion of the fill spout thereby permitting a visual inspection to be made between the remaining portion of the fill spout and the nozzle.

2. The funnel of claim 1 in which said mounting flange includes a plurality of generally parallel outwardly spaced ribs which are oriented generally perpendicularly with respect to the orientation of said nozzle, said ribs extending from said mounting flange toward said nozzle.

3. The funnel of claim 2 in which said mounting flange extends at least approximately 90° with respect to the periphery of said nozzle.

4. The funnel of claim 3 in which said mounting flange is integrally formed with said nozzle.

5. The funnel of claim 1 in which said mounting flange extends at least approximately 90° with respect to the periphery of said nozzle.

6. The funnel of claim 5 in which said mounting flange includes side edges, said side edges being flared outwardly with respect to said nozzle.

7. The funnel of claim 1 in which said mounting flange includes side edges, said side edges being flared outwardly at an angle relative to said nozzle.

8. The funnel of claim 1 in which said mounting flange is integrally formed with said nozzle.

* * * * *